US005335436A

United States Patent [19]

Gurr

[11] Patent Number: 5,335,436

[45] Date of Patent: Aug. 9, 1994

[54] ANIMAL PROP USING AIR BAGS

[75] Inventor: Robert H. Gurr, Los Angeles, Calif.

[73] Assignee: MCA Recreation Services, Inc., North Hollywood, Calif.

[21] Appl. No.: 9,380

[22] Filed: Jan. 27, 1993

Related U.S. Application Data

[63] Continuation of Ser. No. 665,369, Mar. 5, 1991, abandoned.

[51] Int. Cl.[5] ..... G09F 19/08

[52] U.S. Cl. ..... 40/412; 446/226

[58] Field of Search ..... 40/412, 212, 214, 215, 40/411, 418–420; 446/226, 221, 362

[56] References Cited

U.S. PATENT DOCUMENTS

| | | | |
|---|---|---|---|
| 536,512 | 3/1895 | Crossley . | |
| 1,218,852 | 3/1917 | Gilpin . | |
| 1,632,356 | 6/1927 | Weimer . | |
| 1,634,189 | 6/1927 | Henry | 446/226 |
| 1,901,150 | 3/1933 | Dorogi et al. . | |
| 2,047,377 | 7/1936 | Liwschutz | 40/412 X |
| 2,131,496 | 9/1938 | Auger . | |
| 2,503,948 | 4/1950 | Henry . | |
| 2,698,499 | 1/1955 | Dygon | 446/198 |
| 2,731,768 | 1/1956 | Harrowe . | |
| 2,751,708 | 6/1956 | Plummer | 446/223 |
| 2,826,000 | 3/1958 | Fischman et al. | 446/223 |
| 3,090,049 | 5/1963 | Lanteigne . | |
| 4,055,020 | 10/1977 | Kosicki et al. . | |
| 4,091,482 | 5/1978 | Malcolm | 5/413 |
| 4,242,830 | 1/1981 | Hauser . | |
| 4,271,620 | 6/1981 | Vicino et al. | 40/412 X |
| 4,318,244 | 3/1982 | Magid et al. | 446/221 X |
| 4,683,669 | 8/1987 | Greer, Jr. | 40/414 |
| 4,759,737 | 7/1988 | Ferenczi . | |
| 4,799,889 | 1/1989 | Yockey | 446/328 X |
| 5,104,346 | 4/1992 | Smrt | 40/412 X |
| 5,205,774 | 4/1993 | Smrt | 40/412 X |

FOREIGN PATENT DOCUMENTS

| | | | |
|---|---|---|---|
| 1375573 | 11/1963 | France . | |
| 1507557 | 1/1967 | France . | |
| 912716 | 1/1961 | United Kingdom . | |
| 941546 | 11/1963 | United Kingdom . | |
| 2214830 | 9/1989 | United Kingdom | 446/226 |
| 9112863 | 9/1991 | World Int. Prop. O. | 40/412 |

*Primary Examiner*—Kenneth J. Dorner
*Assistant Examiner*—Milton Nelson, Jr.
*Attorney, Agent, or Firm*—Lyon & Lyon

[57] ABSTRACT

An animal prop having a body or appendages with rip-stop nylon air bags surrounding a support member. The air bags are attached to each other with zippers. A blower provides air to the air bags through air hoses. A liner surrounds the air bags. A fur cloth covering simulating animal skin or fur is placed over the liner. A life-like appearance and movement is provided as the air bags roll, billow or deform with movement of the prop.

9 Claims, 2 Drawing Sheets

ANIMAL PROP USING AIR BAGS

This application is a continuation application of application Ser. No. 07/665,369, filed on Mar. 13, 1991 and now abandoned.

BACKGROUND OF THE INVENTION

Large animal props are frequently used in parades or in theme or amusement parks. The prop should appear life-like yet it must also be relatively durable and lightweight. The surface of the prop must accurately simulate the animal represented by the prop. The appendages of the prop, for example, arms and legs, must be articulated and flex and move in a life-like manner. It is therefore an object of the invention to provide a prop for simulating part of or an entire animal having a natural and life-like appearance of animal fur.

It is a further object of the invention to provide such a prop which is suitable for use on very large size animal simulations, but with a minimum of weight.

It is a further object of the invention to provide such a prop which is durable and easily maintained. Other objects and advantages will appear hereinafter.

SUMMARY OF THE INVENTION

These and other related objects are achieved according to the invention by a prop for simulating part of or an entire animal having an air bag with a liner encompassing the air bag. A simulated animal skin overlies the liner. An air source, such as a blower is connected to the air bag through a flexible air hose.

Preferably, a relatively rigid support member is attached to the air bag. In a preferred embodiment, a plurality of air bags are secured around the support member. The air bags may be attached to each other using, for example, zippers. Most desirably the air bags are made of rip-stop nylon.

Especially with large size props, a main internal frame is provided to support the body of the prop. Arms or legs of the animal prop are attached to the body and include a support member attached directly or indirectly to the main frame. Two, three or four air bags are attached around the support member, and air hoses supply air to each air bag. The air bags are zippered together. A liner surrounds the air bags and an animal skin is provided over the prop and the liner. The air bags have relatively low pressure and movement of the prop will cause flexing or rolling of the air bags giving the appearance of a fur covered animal body, for example, a gorilla.

BRIEF DESCRIPTION OF THE DRAWINGS

Other objects and features of the present invention will become apparent from the following detailed description taken in connection with the accompanying drawings which disclose a single embodiment of the invention. It is to be understood, however, that the drawings are designed for the purpose of illustration only and are not intended as a definition of the limits of the invention.

In the drawings, wherein similar reference characters denote similar elements throughout the several views.

DETAILED DESCRIPTION OF THE PREFERRED EMBODIMENT

Figure 1:
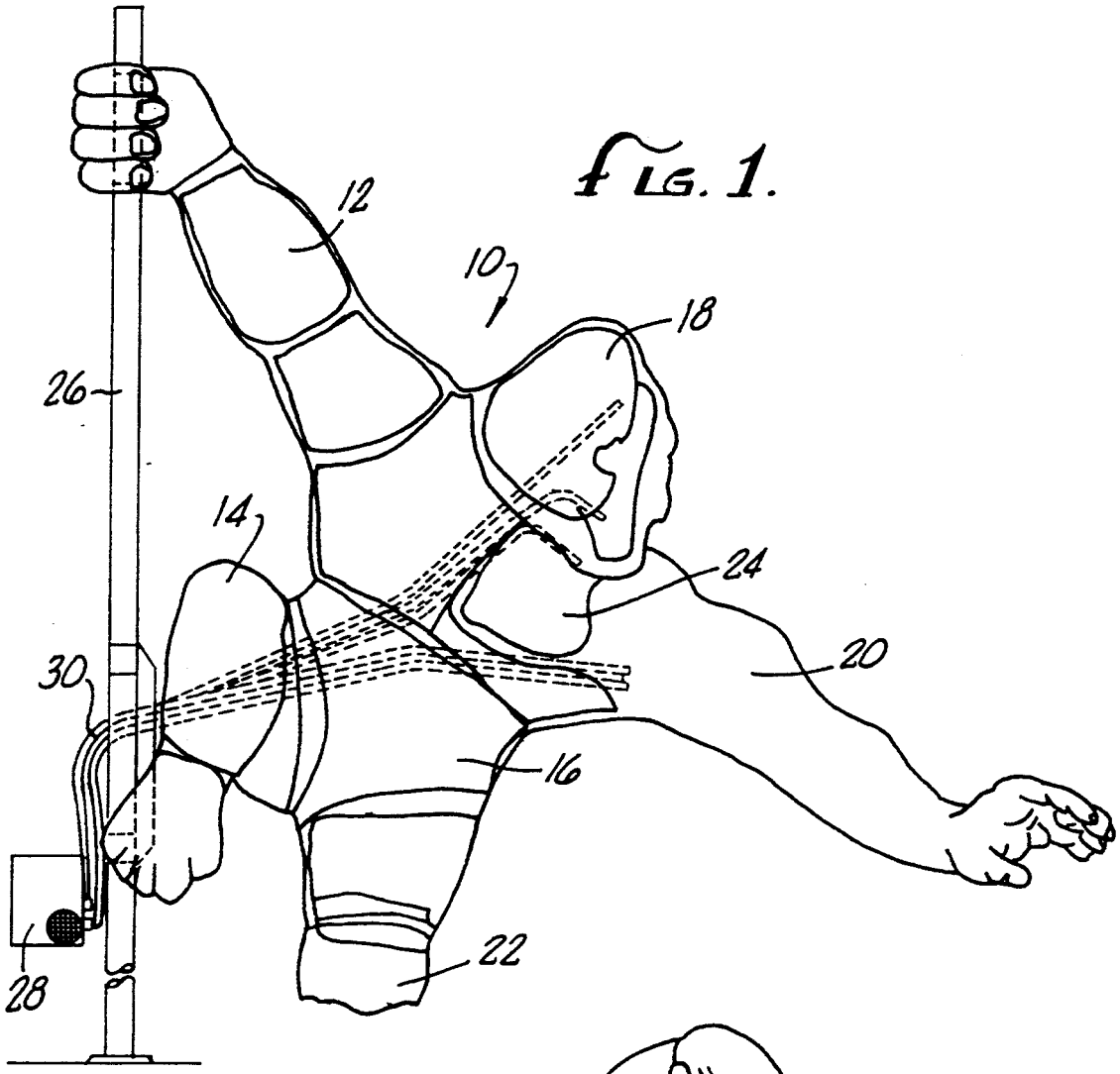
FIG. 1 is a schematically illustrated front elevation view fragment of the animal prop of the invention.

Referring now in detail to the drawings, as illustrated in FIG. 1, an animated animal prop 10 has a torso 16, arms 12 and 20, legs 14 and 22, as well as a head 18 attached to the torso 16. The prop 10 has fiberglass or aluminum body panel shells 24 shaped to provide an appropriate body contour at specific locations on the prop 10. The body panel shells 24 are supported by fixed or moveable internal framework members. Urethane or other elastomeric or fabric skin is provided on the face, hands and other exposed surfaces. Depending upon the movement or action sequence performed by the animated prop 10, a scenery support prop 26, e.g., in the form of an office building edifice can be provided.

As described further below, air bags are provided at certain portions of the animated prop 10. An air blower 28 is linked to the air bags through air hoses 30. The air blower 28 provides low pressure air for the cheeks, neck and stomach air bags of the prop. Medium pressure air is provided by the air blower 28 to the shoulder air bags and chest air bags. The blower 28 also provides relatively high pressure air for an air bag at the back of the head. The higher the pressure in the air bags, the stiffer and less flexible will be the particular body portion of the prop 10. For example, the low pressure cheek and stomach air bags will be relatively soft and readily provide a rolling surface appearance with movement of the prop 10 yielding a highly realistic effect.

Figure 2:
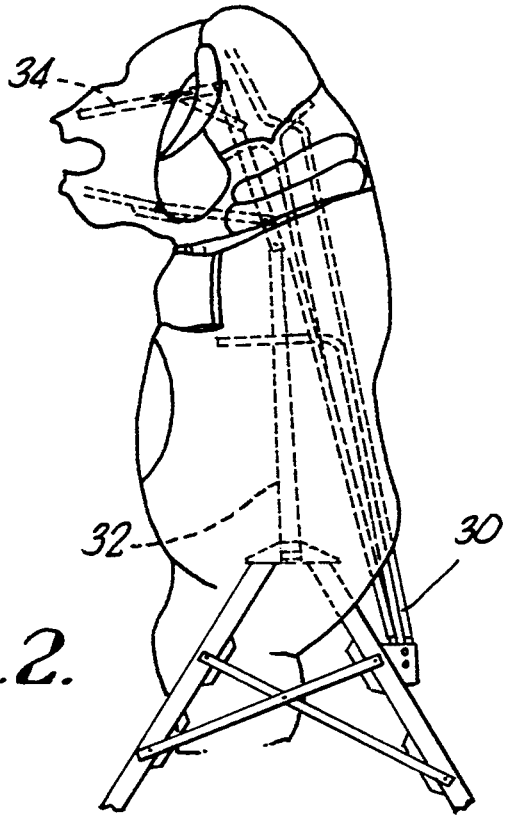
FIG. 2 is a schematically illustrated side view fragment thereof.

As shown in FIG. 2, since the prop 10 can be made to a relatively large size, for example a 30 foot prop, a relatively rigid metal or fiberglass main frame 32 is provided within the prop 10 for structural support. Articulated or movable frame extensions 34 jointed to the main frame 32 are provided to support protrusions or appendages. The extensions 34 are moved or driven by actuators, preferably in a controlled sequence to simulate life-like movement. In addition to the body panels 24, ribs sculpted from urethane foam are provided on the torso 16 to help maintain a proper torso shape.

Figure 3:
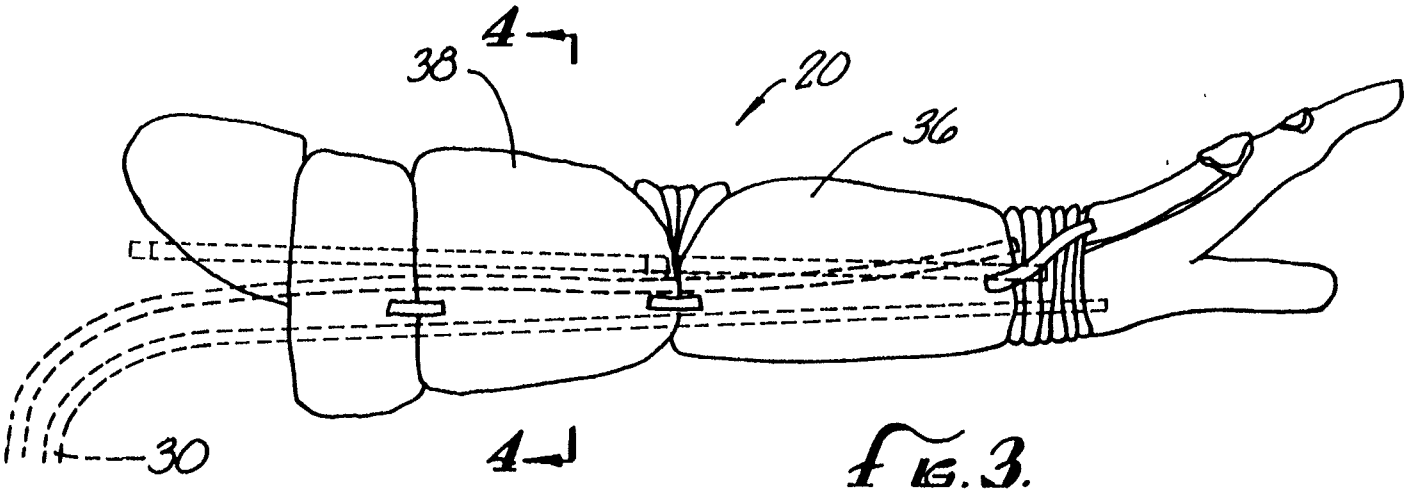
FIG. 3 is an enlarged front elavation view of the arm of the animal prop of FIG. 1.
Figure 4:
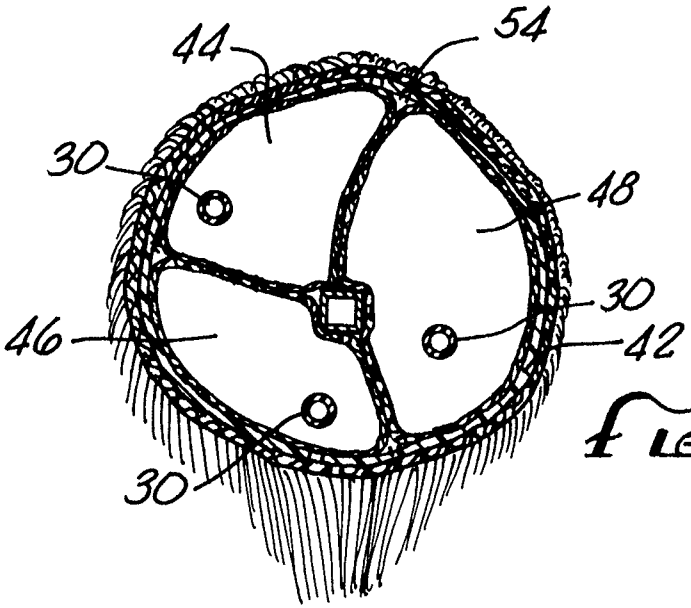
FIG. 4 is a section view taken along line 4—4 of FIG. 3.

Referring to FIGS. 3 and 4, to create an appendage, e.g., an arm, which has a life-like appearance and surface movement, air bags of various sizes and shapes are used to form the arm. The arm 20 shown in FIG. 3 includes a forearm air bag unit 36 and an upper arm air bag unit 38. As the frame extensions 34 are moved, the limbs or torso sections can flex and push into and against each other. The underlying air bags flex or deform creating a highly realistic animal body appearance.

Referring to FIG. 4, a support member 50 for example, a relatively rigid or aluminum or fiberglass section extends through the arm 20. Positioned around the support member 50 are upper arm air bags 44, 46 and 48. These air bags are preferably made of rip-stop (i.e., thin impervious) nylon. An air hose provides air to each of these air bags from the blower 28. Zippers 54 are provided at the outside longitudinal edges of the air bags 44, 46 and 48 to attach the air bags together around the support member 50. Surrounding the air bags 44, 46 and 48 is a liner 42 made of a low friction material. A fur cloth covering 40 covers the liner 42. The liner 42 and fur cloth covering typically each extend in a single piece from the wrist or elbow to the shoulder, thereby covering several air bag units comprising the arm 20. The liner 42 allows the fur cloth covering 40 to move or slide in relation to the air bags as the arm 20 is moved and flexed. This construction allows for the design of very large size props heretofore not feasible using known techniques.

Thus, while a single embodiment of the present invention has been shown or described, it will be obvious that many changes and modifications will be made thereunto, without departing from the spirit and scope of the invention.

We claim:

1. An inflatable figure comprising:

a fixed rigid frame;

at least one frame extension articulated to the frame;

a plurality of flexible air bags attached around the frame extension;

means for supplying air at first pressure to at least one of the plurality of air bags, the means for supplying also connected and supplying air at a second pressure, different from the first pressure, to at least another of the plurality of air bags; and a flexible simulated skin supported on the air bags.

2. The inflatable figure of claim 1 further comprising a body panel shell supported on the frame extension.

3. The inflatable figure of claim 1 further comprising a body panel shell supported on the fixed rigid frame.

4. An animal prop comprising:

a fixed rigid frame;

at least one frame extension articulated to the frame;

a plurality of flexible air bags substantially enclosing the fixed frame and the frame extension;

a low friction material flexible liner generally surrounding each air bag;

means for supplying air at a first pressure to at least some of the plurality of air bags, the means for supplying also connected and supplying air at a second pressure, different from the first pressure, to at least some of the plurality of air bags not supplied with air at the first pressure;

means for attaching the air bags to the fixed frame and to the frame extension; and a flexible simulated animal skin overlying the air bags.

5. The prop of claim 4 wherein the simulated animal skin comprises synthetic fur.

6. The prop of claim 4 wherein the means for attaching the air bags to each other comprises zippers.

7. The prop of claim 4 wherein the air bags comprise rip-stop Nylon.

8. The prop of claim 4 further comprising a second frame extension articulated to the frame extension.

9. The prop of claim 4 wherein the simulated animal skin comprises woven modified acrylic fibers.

* * * * *